US006317904B1

(12) United States Patent
Samelson

(10) Patent No.: US 6,317,904 B1
(45) Date of Patent: Nov. 20, 2001

(54) SHOWER CURTAIN

(75) Inventor: David Samelson, Morristown, NJ (US)

(73) Assignee: Ex-Cell Home Fashions, Inc., N.Y., NY (US)

( * ) Notice: Subject to any disclaimer, the term of this patent is extended or adjusted under 35 U.S.C. 154(b) by 0 days.

(21) Appl. No.: 09/637,148

(22) Filed: Aug. 14, 2000

Related U.S. Application Data

(60) Provisional application No. 60/154,578, filed on Sep. 17, 1999.

(51) Int. Cl.[7] ..... A47K 3/08

(52) U.S. Cl. ..... 4/558; 4/608; 4/610

(58) Field of Search ..... 4/558, 607, 608, 4/610, 583; 248/205.2, 206.2, 206.3; 362/397

(56) References Cited

U.S. PATENT DOCUMENTS

| | | | | |
|---|---|---|---|---|
| 1,577,608 | * | 3/1926 | Brewer | 4/583 |
| 2,232,194 | | 2/1941 | Zogby . | |
| 2,303,502 | | 12/1942 | Rous . | |
| 2,608,250 | * | 8/1952 | Meyer . | |
| 2,642,248 | * | 6/1953 | Semon . | |
| 3,076,976 | * | 2/1963 | Bogar . | |
| 3,299,885 | * | 1/1967 | Wessel . | |
| 3,623,641 | * | 11/1971 | Hansen . | |
| 3,639,919 | * | 2/1972 | White . | |
| 3,727,868 | * | 4/1973 | Buchanan . | |
| 4,070,735 | * | 1/1978 | Canaday . | |
| 4,279,396 | | 7/1981 | Bendock . | |
| 4,723,326 | | 2/1988 | Tarlow et al. . | |
| 5,023,964 | | 6/1991 | Unsworth . | |
| 5,070,551 | | 12/1991 | Harrison et al. . | |
| 5,421,393 | | 6/1995 | Wolfe . | |
| 5,829,071 | * | 11/1998 | Lavalle | 4/605 |

FOREIGN PATENT DOCUMENTS

2118238 * 10/1983 (GB) .

* cited by examiner

*Primary Examiner*—Gregory L. Huson
*Assistant Examiner*—Khoa D. Huynh
(74) *Attorney, Agent, or Firm*—Robert L. Epstein; Harold James; James & Franklin, LLP

(57) ABSTRACT

A plurality of fasteners are arranged along opposite edges of the shower curtain. Each fastener includes a mounting strip with a body portion which carries a pair of integral suction cups. The strip is heat sealed to the curtain material. In particular, a peripheral edge, thinner than the body portion, is formed during the heat sealing process. A passage or opening through the body portion acts as a guide during the heat sealing process and permits air trapped during sealing or water trapped during use to escape from behind the mounting strip.

6 Claims, 2 Drawing Sheets

FIG. 2
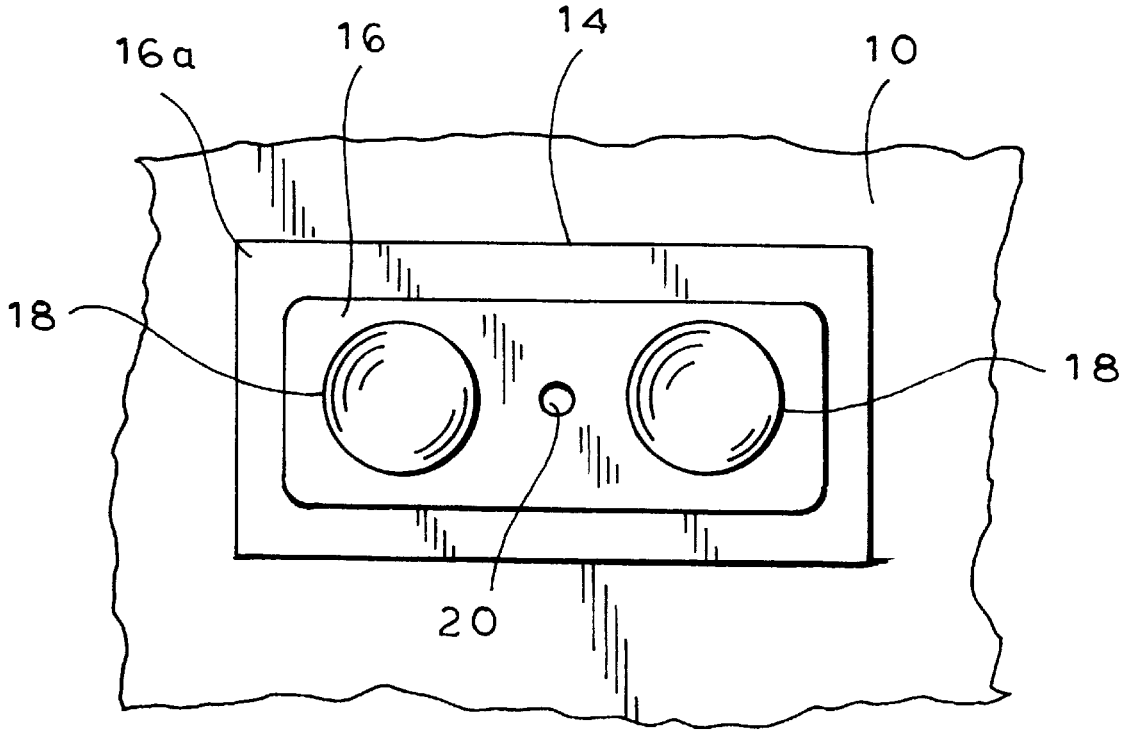
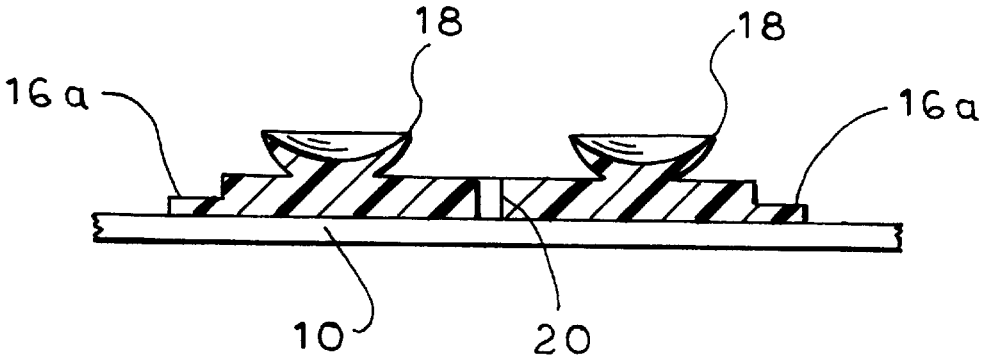
FIG. 3

SHOWER CURTAIN

Priority on provisional application Serial No. 60/154,578 filed Sep. 17, 1999, is hereby claimed.

BACKGROUND OF THE INVENTION

1. Field of the Invention

The present invention relates to shower curtains and liners and, more particularly, to shower curtains and liners with curtain fasteners, or closure elements, for retaining the curtains in place.

2. Description of Related Art

Shower curtains are often used in combination with a waterproof liner wherein the curtain is maintained outside of the shower or bath tub and the liner is disposed inside to act as a barrier for shower water. In some instances, the curtain itself is waterproof and is used as a liner or, optionally, as a curtain or liner. The present invention is applicable to both curtains and liners and the word curtain is used hereinafter for purposes of simplicity to denote both curtains and liners.

Shower curtains normally hang from a bar or rod which is disposed adjacent to the shower enclosure or bathtub and below the ceiling. In use, a shower curtain is sometimes caused to billow out over the edge of the shower stall or bathtub or to have the lower edge thereof slip outside the shower stall or bathtub, so that water spills or drips onto the floor (by, e.g., the rush of shower water, air turbulence, or the unintended movement of the user). Other problems with conventional shower curtains include clinging of the curtain to the body of the user upon such billowing, and the curling of the curtain at the side edges thereof so that this edge sticks to a further portion of the curtain, and spills or drips occur.

A number of different approaches and techniques have been used in attempting to maintain a shower curtain in place. These techniques and approaches include, inter alia, the use of weights, magnets and suction cups. Such techniques are described, for example, in the following U.S. Pat. No. 5,421,393 (Wolfe); U.S. Pat. No. 5,023,964 (Unsworth); U.S. Pat. No. 5,070,551 (Harrison et al); U.S. Pat. No. 4,723,326 (Tarlow et al); U.S. Pat. No. 4,279,396 (Bendock); U.S. Pat. No. 4,070,735 (Canaday); U.S. Pat. No. 2,303,502 (Ruos); U.S. Pat. No. 2,232,194 (Zogby), and in the prior art cited in these patents. Because, as set forth below, the present invention involves the use of suction cups, the Canaday patent, among others, is of particular interest. This patent discloses a shower curtain fastener comprising an elongate short flexible strip formed with a series of four integral suction cups arranged in a row on one surface thereof and ridges and depressions on the opposite surface. The ridges and depressions define an expanded surface area to which an adhesive layer is applied. A cover sheet with a release coating is applied to the adhesive layer. In use, the latter layer is pulled off and the adhesive layer is pressed adjacent to the margin or edge of the shower curtain. The suction cups are pressed against the sidewall of the shower enclosure in order to temporarily hold the shower curtain against the sidewall. The Unsworth, Bendock, Harrison, et al, Rous, and Zogby patents all disclose shower curtains using suction cups in various forms.

A further common problem with shower curtains is a susceptibility to the germs, mold and mildew created in the damp shower environment. Many of the shower closures and fasteners of the prior art are preferred sites for such germs, mold and mildew.

A further disadvantage of many prior art fasteners is that they are obtrusive, ungainly and/or unsightly in appearance and thus, are unattractive to potential purchasers of the associated shower curtain.

SUMMARY OF THE INVENTION

In accordance with the invention, an improved shower curtain is provided which provides a number of important advantages over the prior art. The shower curtain includes a plurality of fasteners arranged along opposite edges thereof. In an advantageous embodiment, two such fasteners are provided along each edge. The fasteners each comprise a mounting strip which carries, and is formed integrally with, a pair of suction cups arranged in a row along the longitudinal axis of the mounting strip. The mounting strip is heat sealed to the shower curtain and, in particular, a peripheral edge or skirt portion of the mounting strip is formed during the heat sealing process and this edge or skirt portion is directly sealed to the curtain material. A very small central hole or opening is provided between the suction cups which acts as a guide during the heat sealing process and also serves additional functions which combat the formation of mold and mildew. For example, the hole permits any air trapped during heat sealing to escape, and also enables release of any water that becomes trapped behind the mounting strip for whatever reason. The fasteners of the invention are very small in size and are made of clear plastic and thus are quite unobtrusive, particularly when not in use.

Further features and advantages of the present invention will be set forth in, or apparent from, the detailed description of preferred embodiments thereof which follows.

BRIEF DESCRIPTION OF THE DRAWINGS

FIG. 2 is a top plan view of one of the suction cup fasteners of FIG. 1; and FIG. 3 is a cross-sectional view of the fastener shown in FIG. 2.

DESCRIPTION OF THE PREFERRED EMBODIMENTS

Figure 1:
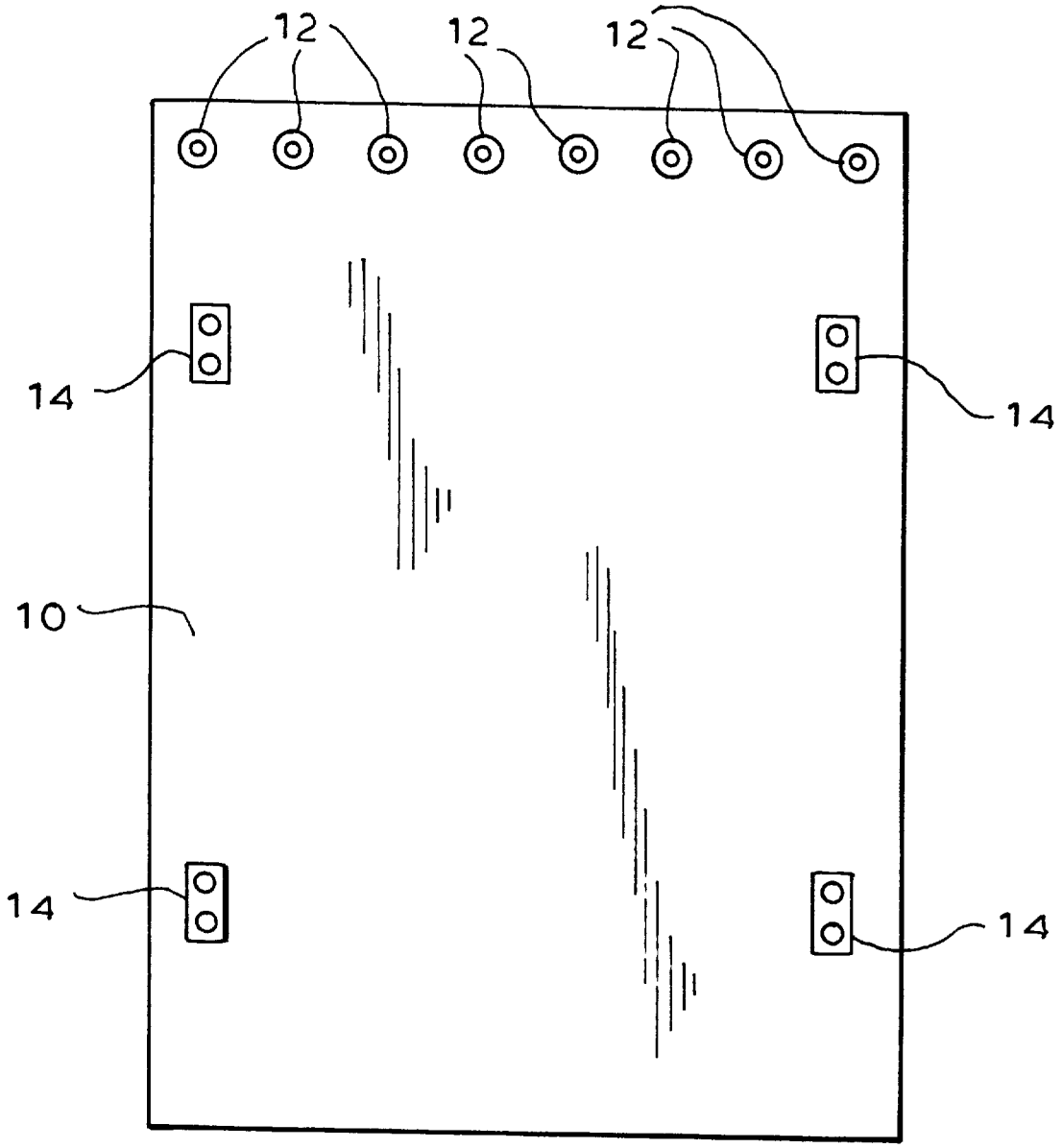
FIG. 1 is a plan view of a shower curtain constructed in accordance with a preferred embodiment of the invention.

Referring to FIG. 1, a shower curtain, which is generally denoted 10, includes conventional metal grommets 12 for receiving support rings for supporting the curtain 10 on a horizontal bar or rod in a shower or bathtub enclosure. The shower curtain 10 can itself be made of polyvinyl or any other suitable material.

Positioned along the opposed margins or side edges of the shower curtain 10 are two pairs of fasteners 14, one pair along each edge as shown. The fasteners 14 of each pair are spaced apart from each other and are permanently affixed to the curtain material. Although the drawings are not to scale, fasteners 14 are quite small in size and are made of a clear plastic so that the fasteners are quite unobtrusive when the curtain 10 is viewed.

The fasteners 14 are shown in more detail in FIGS. 2 and 3, and, as illustrated, include a mounting strip 16 of a generally rectangular shape having a pair of suction cups 18 mounted thereon and formed integrally therewith. Strip 16 includes an outlying peripheral portion 16*a* which is formed when strip 16 is heat sealed to the curtain 10. Such heat sealing provides excellent holding particularly in a damp environment. Thus, peripheral portion 16*a* is firmly sealed to the curtain 10 while the central portion of strip 16 presses against the curtain 10.

It is noted that use of only two suction cups 18, and the attendant use of cups of small size, are important in avoiding a problem associated with a number of prior art fasteners. This problem concerns the grout lines which are found in shower and bath installations. A suction cup pressed against such a grout line may initially stick but will tend to separate after a fairly short time. It has been found that two suction cups of relatively small size provide the requisite holding suction power so long as the cups are not pressed against a grout line and this is less likely to happen with the small, two cup construction of the invention.

A further important feature of fasteners 14 is a central opening 20 provided between suction cups 18. Opening 20 assists in orientation of the heat sealing apparatus but also serves to release any air captured under the mounting strip 16 during the heat sealing operation. Further opening 20 provides for the release of water trapped under strip 16 under circumstances where, for example, the curtain 10 is torn or the seal damaged, permitting water to collect behind strip 16.

Although these dimensions are only exemplary rather than limiting, in an advantage embodiment, the suction cups 18 having a diameter of about 0.45 inches and the raised portion of strip 16 (inside of peripheral portion 16*a*) is about 1.3 inch by about 0.65 inch.

I claim:

1. A shower curtain comprising a plurality of fasteners arranged along opposite edges thereof, said fasteners each comprising a mounting strip, a pair of suction cups arranged in a row along the longitudinal axis of said mounting strip, said mounting strip comprising a body portion having a given thickness and a peripheral edge portion substantially surrounding and extending beyond said body portion, said edge portion having a thickness substantially less than said thickness of said body portion and being sealed directly to the curtain material and an opening through said body, proximate said suction cups.

2. The shower curtain of claim 1 wherein two of said fasteners are provided along each of said edges of the shower curtain.

3. The shower curtain of claim 1 to wherein said suction cups are integral with said body portion.

4. The shower curtain of claim 1 wherein said opening is situated between said suction cups.

5. The shower curtain of claim 1 wherein said opening provides a passage permitting air trapped behind said mounting strip during heat sealing to escape.

6. The shower curtain of claim 1 wherein said opening provides a passage for water trapped behind said mounting strip to escape.

* * * * *